US010781401B2

(12) United States Patent
Klemmer et al.

(10) Patent No.: US 10,781,401 B2
(45) **Date of Patent: *Sep. 22, 2020**

(54) STRUCTURED WASHING AGENT OR CLEANING AGENT WITH A FLOW LIMIT

(71) Applicant: Henkel AG & Co. KGaA, Duesseldorf (DE)

(72) Inventors: Anna Klemmer, Duesseldorf (DE); Olga Morozova, Duesseldorf (DE); Peter Schmiedel, Duesseldorf (DE); Dieter Nickel, Pulheim (DE); Lars Janzen, Hilden (DE); Bent Rogge, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/113,367

(22) Filed: Aug. 27, 2018

(65) Prior Publication Data

US 2019/0062673 A1 Feb. 28, 2019

(30) Foreign Application Priority Data

Aug. 28, 2017 (DE) ..... 10 2017 215 016

(51) Int. Cl.

| | |
|---|---|
| ***C11D 1/02*** | (2006.01) |
| ***C11D 1/66*** | (2006.01) |
| ***C11D 1/83*** | (2006.01) |
| ***C11D 3/04*** | (2006.01) |
| ***C11D 3/20*** | (2006.01) |
| ***C11D 3/37*** | (2006.01) |
| ***B08B 3/04*** | (2006.01) |
| ***C11D 1/831*** | (2006.01) |
| ***C11D 17/00*** | (2006.01) |
| ***C11D 3/12*** | (2006.01) |
| *C11D 1/75* | (2006.01) |
| *C11D 1/12* | (2006.01) |
| *C11D 1/74* | (2006.01) |
| *C11D 1/22* | (2006.01) |
| *C11D 1/29* | (2006.01) |
| *C11D 1/72* | (2006.01) |

(52) U.S. Cl.

CPC ..... *C11D 1/831* (2013.01); *C11D 1/83* (2013.01); *C11D 3/042* (2013.01); *C11D 3/046* (2013.01); *C11D 3/122* (2013.01); *C11D 3/2013* (2013.01); *C11D 3/2041* (2013.01); *C11D 3/2044* (2013.01); *C11D 3/2048* (2013.01); *C11D 3/2068* (2013.01); *C11D 3/2093* (2013.01); *C11D 3/2096* (2013.01); *C11D 17/0026* (2013.01); *C11D 1/12* (2013.01); *C11D 1/22* (2013.01); *C11D 1/29* (2013.01); *C11D 1/662* (2013.01); *C11D 1/72* (2013.01); *C11D 1/74* (2013.01); *C11D 1/75* (2013.01)

(58) Field of Classification Search

CPC .... C11D 1/02; C11D 1/66; C11D 1/83; C11D 3/04; C11D 3/20; C11D 3/37; B08B 3/04

See application file for complete search history.

(56) References Cited

U.S. PATENT DOCUMENTS

| | | | | |
|---|---|---|---|---|
| 9,023,786 B2 * | 5/2015 | Schmiedel | ..... | C11D 1/831 510/504 |
| 2014/0235524 A1 * | 8/2014 | Schmiedel | ..... | C11D 1/831 510/427 |

FOREIGN PATENT DOCUMENTS

| | | | |
|---|---|---|---|
| DE | 102011085638 | A1 | 5/2013 |
| DE | 102012211028 | A1 | 1/2014 |
| DE | 102012219218 | A1 | 4/2014 |
| DE | 102015206547 | A1 | 10/2016 |
| WO | 9318127 | A1 | 9/1993 |
| WO | 2013064357 | A1 | 5/2013 |

OTHER PUBLICATIONS

European Search Report EP 18187316 dated Oct. 12, 2018 7 Pages.

* cited by examiner

*Primary Examiner* — Brian P Mruk
(74) *Attorney, Agent, or Firm* — Thomas G. Krivulka

(57) ABSTRACT

A structured liquid washing agent or cleaning agent with a flow limit, containing a surfactant system of anionic surfactants, nonionic surfactants and co-surfactants, inorganic salt and an amphiphilic compound, as well as a washing method in which the washing agent or cleaning according to the invention is used, and corresponding uses.

14 Claims, No Drawings

STRUCTURED WASHING AGENT OR CLEANING AGENT WITH A FLOW LIMIT

FIELD OF THE INVENTION

The present patent application is directed at a structured liquid washing agent or cleaning agent with a flow limit, containing a surfactant system of anionic surfactants, nonionic surfactants and co-surfactants, an inorganic salt and an amphiphilic compound, as well as a washing method in which the washing agent or cleaning agent according to the invention is used, and corresponding uses.

BACKGROUND OF THE INVENTION

It is often problematic to suspend solids in liquids in a stable form. In particular when the solids have a different density from the liquid, they tend to sediment or float. However, it is desirable for aesthetic reasons as well as reasons of stability and functionality of a formulation to incorporate particles, in particular of a micrometer size (e.g., microcapsules such as perfume microcapsules or other particles such as abrasive particles or insoluble constituents) in liquid washing agents and cleaning agent formulations. First, such liquid washing agents and cleaning agents that contain microcapsules/particles are visually attractive for consumers. Second, it is desirable to incorporate microcapsules into liquid washing agents and cleaning agents not only for aesthetic reasons but also for functional reasons because such particles facilitate the separation of chemically incompatible ingredients and controlled and/or delayed release of ingredients. For such formulations, however, it is important for the visible particles to be uniformly distributed in washing agents and to dissolve only as needed (during the washing). It is unintended, for aesthetic reasons in particular, that the particles float, sink or otherwise accumulate or aggregate in the liquid matrix excessively during storage.

It is known from the prior art that a stable suspension of particles in a liquid washing agent matrix can optionally be achieved by adjusting a flow limit by using structured surfactant systems. International Patent Publication WO 2013/089646 A1, for example, describes such structured surfactant systems that have a flow limit. WO 2013/064357 A1 also describes structured liquid washing agents and cleaning agents that contain a system of anionic, nonionic and co-surfactants as well as an inorganic salt.

Although such agents have advantageous rheological properties which enable stable dispersion of particles, it has been found that they also have a number of disadvantages. For example, the concentration window for a suitable and aesthetic flow behavior is relatively small. At low concentrations, the flow limit disappears or a phase separation occurs. At high concentrations the flow limit and viscosity increase sharply, which has a negative effect on the flow behavior and also has practical effects such as making it difficult to empty the package, in addition to aesthetic problems. Furthermore, it has been found that even with minor changes in concentration or the type of individual components, for example, salt, co-surfactant, etc., the stability of the formulation can be significantly impaired, such that phase separation occurs. For these reasons it is also practically impossible to influence the rheology without altering other important properties of the formulation, for example, the ratio of the different surfactants. Another disadvantage is that such formulations are strongly shear diluting. The result is a marked degradation of the viscosity and the flow limit with motion, which results in sedimentation or accumulation of particles. In concrete terms this means, for example, that with movement of the package such as shaking, inclination, etc., for example, the viscosity and flow limit decrease locally to such a great extent that particles from these regions accumulate in other regions of a higher viscosity/flow limit. This is then manifested visually in that the solid particles accumulate at certain locations in the container and are no longer uniformly distributed.

There is therefore a demand for structured liquid washing agents and cleaning agents which eliminate or reduce the disadvantages described above.

It has now surprisingly been found that the aforementioned disadvantages can be reduced or eliminated by using an amphiphilic compound in addition to a structure-forming surfactant system. This effect can be further enhanced by using a structure-imparting polymer and/or a hydrotropic compound.

BRIEF SUMMARY OF THE INVENTION

In a first aspect, the subject matter of the invention is therefore a structured liquid washing agent or cleaning agent with a flow limit, containing based on the total weight of the agent:

(A) 6 to 70 wt %, preferably 6 to 45 wt % of a surfactant mixture containing, based on the total weight of the agent:

(i) 5 to 50, preferably 5 to 35, even more preferably 5 to 20 wt % anionic surfactant, selected from the group consisting of sulfate surfactants, sulfonate surfactants and mixtures thereof;

(ii) 0.5 to 35, preferably 1 to 25, even more preferably 1 to 15 wt % nonionic surfactant, selected from the group consisting of alkoxylated fatty alcohols with a degree of alkoxylation of ≥4, alkoxylated fatty acid esters, fatty acid amides, alkoxylated fatty acid amides, polyhydroxy fatty acid amides, alkyl phenol polyglycol ethers, amine oxides, alkyl polyglucosides and mixtures thereof; and (iii) 0.5 to 5 wt % of a co-surfactant selected from the group consisting of alkoxylated $C_8$-$C_{18}$ fatty alcohols with a degree of alkoxylation of <3, aliphatic $C_6$ to $C_{14}$ alcohols, aromatic $C_6$ to $C_{14}$ alcohols, aliphatic $C_6$ to $C_{12}$ dialcohols, monoglycerides of $C_{12}$ to $C_{18}$ fatty acids, monoglycerol ethers of $C_8$ to $C_{18}$ fatty alcohols and mixtures thereof, preferably $C_{12}$ to $C_{18}$ fatty alcohols with a degree of alkoxylation of <3;

(B) 0.5 to 10 wt % inorganic salt and (C) 0.1 to 5 wt % preferably 1 to 2 wt % of a liquid amphiphilic organic compound selected from mono-, di- or polyhydric alcohols, ethers, esters, dioxolanes and combinations thereof, selected in particular from the group consisting of butyl glycol, propylene glycol, 3-methoxy-3-methyl-1-butanol, 2,2-dimethyl-4-hydroxymethyl-1,2-dioxolane, propylene carbonate, butyl lactate, 2-isobutyl-2-methyl 1,3-dioxolane-4-methanol or mixtures thereof, especially preferably propylene carbonate.

Another aspect of the invention relates to a washing method that can also be carried out in the household, comprising the method steps:

a) Providing a washing or cleaning solution comprising a liquid washing agent or cleaning agent according to the invention with a flow limit as described herein, and b) Bringing a textile fabric or a hard surface in contact with a washing or cleaning solution according to (a).

Finally, use of the agents described herein as washing agents or cleaning agents, e.g., for textile fabrics or hard surfaces, is also the subject matter of the present invention.

"At least one" as used herein denotes 1 or more, i.e., 1, 2, 3, 4, 5, 6, 7, 8, 9 or more. Based on one ingredient, this information refers to the type of ingredient and not the absolute number of molecules. Together with weight information, this information is based on all the compounds of the type indicated which are present in the composition, i.e. the composition does not contain any additional compounds of this type beyond the stated quantity of the corresponding compounds.

Unless explicitly stated otherwise, all percentage amounts given in conjunction with the compositions/agents described herein are given in percentage by weight or wt %, each based on the respective composition.

The liquid washing agents or cleaning agents contain at least one anionic surfactant, at least one nonionic surfactant, at least one inorganic salt, at least one co-surfactant and at least one amphiphilic compound.

Sulfonates and/or sulfates are used as the anionic surfactant. The anionic surfactant content amounts to 5 to 50 wt %, preferably 5 to 35 wt %, even more preferably 5 to 20 wt %, each based on the total washing agent or cleaning agent.

Surfactants of the sulfonate type that may be considered preferably include $C_9$-$C_{13}$ alkylbenzene sulfonates, olefin sulfonates, i.e., mixtures of alkene sulfonates and hydroxyalkane sulfonates as well as disulfonates such as those obtained, for example, from $C_{12}$-$C_{18}$ monoolefins with terminal or internal double bonds by sulfonation with gaseous sulfur trioxide and then alkaline or acidic hydrolysis of the sulfonation products. Also suitable are $C_8$-$C_{18}$ alkane sulfonates and the esters of α-sulfo fatty acids (ester sulfonates), for example, the α-sulfonated methyl esters of hydrogenated coconut fatty acids, palm kernel fatty acids or tallow fatty acids.

The preferred alk(en)yl sulfates are the alkali and in particular the sodium salts of sulfuric acid hemiesters of $C_{12}$-$C_{18}$ fatty alcohols, for example, from coconut fatty alcohol, tallow fatty alcohol, lauryl alcohol, myristyl alcohol, cetyl alcohol or stearyl alcohol or the $C_{10}$-$C_{20}$ oxo alcohols and the hemiesters of secondary alcohols of these chain lengths. The $C_{12}$-$C_{16}$ alkyl sulfates and $C_{12}$-$C_{15}$ alkyl sulfates as well as $C_{14}$-$C_{15}$ alkyl sulfates are preferably of interest, based on technical washing considerations. 2,3-Alkyl sulfates are also suitable anionic surfactants.

Fatty alcohol ether sulfates, such as the sulfuric acid monoesters of linear or branched $C_{7-21}$ alcohols ethoxylated with 1 to 6 mol ethylene oxide, such as 2-methyl-branched $C_9$ n-alcohols with an average of 3.5 mol ethylene oxide (EO) or $C_{12-18}$ fatty alcohols with 1 to 4 EO are also suitable.

It is preferable for the liquid washing agents or cleaning agents to contain a mixture of sulfonate surfactants and sulfate surfactants. In a particularly preferred embodiment, the liquid washing agent or cleaning agent contains $C_{9-13}$ alkylbenzene sulfonates and fatty alcohol ether sulfates as the anionic surfactants. The ratio of sulfate surfactants to sulfonate surfactants is preferably in the range of 3:1 to 1:3, and more preferably in the range of 3:1 to 1:1. In a particularly preferred embodiment, the liquid washing agent or cleaning agent contains fatty alcohol ether sulfates and $C_{9-13}$ alkylbenzene sulfonates in a 2:1 ratio.

In addition to the anionic sulfate surfactant and/or sulfonate surfactant, the liquid washing agent or cleaning agent may also contain soaps. Saturated and unsaturated fatty acid soaps, such as the salts of lauric acid, myristic acid, palmitic acid, stearic acid, (hydrogenated) erucic acid and behenic acid as well as those from natural fatty acids, in particular, soap mixtures derived from natural fatty acids, for example, coconut fatty acid, palm kernel fatty acid, olive oil fatty acid or tallow fatty acid, are suitable.

The anionic surfactants as well as the soaps may be present in the form of their sodium, potassium, magnesium or ammonium salts. The anionic surfactants are preferably present in the form of their sodium salts. Additional preferred counterions for the anionic surfactants also include the protonated forms of choline, triethylamine, monoethanolamine or methyl ethyl amine.

The amount of soap in the liquid washing agent or cleaning agent is preferably up to 5 wt % or more preferably up to 2 wt %, based on the total amount of washing agent or cleaning agent.

In addition to the anionic surfactant, the washing agent or cleaning agent also contains a nonionic surfactant. Suitable nonionic surfactants include alkoxylated fatty alcohols with a degree of ethoxylation of >4, alkoxylated fatty acid alkyl esters, fatty acid amides, alkoxylated fatty acid amides, polyhydroxy fatty acid amides, alkyl phenol polyglycol ethers, amine oxides, alkyl polyglucosides and mixtures thereof.

Alkoxylated alcohols, advantageously ethoxylated alcohols, in particular primary alcohols, preferably with 8 to 18 carbon atoms and an average of 4 to 12 mol ethylene oxide (EO) per mol alcohol, in which the alcohol radical may be linear or preferably methyl-branched in position 2 and/or may contain linear and methyl-branched radicals in mixture, such as those usually present in oxo alcohol radicals, are preferably used as the nonionic surfactant. In particular, however, alcohol ethoxylates with linear radicals from alcohols of native origin with 12 to 18 carbon atoms are preferred, for example, those from coconut alcohol, palm alcohol, tallow fatty alcohol or oleyl alcohol and 5 to 8 EO per mol alcohol on the average. Preferred ethoxylated alcohols include, for example, $C_{12-14}$ alcohols with 4 EO or 7 EO, $C_{9-11}$ alcohols with 7 EO, $C_{13-15}$ alcohols with 5 EO, 7 EO or 8 EO, $C_{12-18}$ alcohols with 5 EO or 7 EO and mixtures thereof. The stated degrees of ethoxylation are statistical averages, which may be an integer or a fractional number for a specific product. Preferred alcohol ethoxylates have a narrow range homolog distribution (narrow range ethoxylates, NRE). In addition to these nonionic surfactants, fatty alcohols with more than 12 EO may also be used. Examples include tallow fatty alcohol with 14 EO, 25 EO, 30 EO or 40 EO. Nonionic surfactants containing EO groups and PO groups together in the molecule can also be used according to the invention. Furthermore, a mixture of a (more strongly) branched ethoxylated fatty alcohol and an unbranched ethoxylated fatty alcohol is also suitable, such as a mixture of a $C_{16-18}$ fatty alcohol with 7 EO and 2-propylheptanol with 7 EO, for example. In particular the washing agent, cleaning agent, aftertreatment agent or wash aid preferably contains a $C_{12-18}$ fatty alcohol with 7 EO or a $C_{13-15}$ oxo alcohol with 7 EO as a nonionic surfactant.

The nonionic surfactant content amounts to 0.5 to 35 wt %, preferably 1 to 25 wt %, even more preferably 1 to 15 wt %, each based on the total washing agent or cleaning agent.

In preferred embodiments, the liquid washing agent or cleaning agent according to the invention is characterized in that the weight ratio of nonionic surfactant to anionic surfactant is in the range of 1:1 to 1:3, preferably 1:2 to 1:2.5.

The washing agent or cleaning agent according to the invention necessarily contains a co-surfactant, selected from the group consisting of alkoxylated $C_8$-$C_{18}$ fatty alcohols with a degree of alkoxylation of <3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols and mixtures thereof. This co-surfactant is used in an amount of 0.5 to 5 wt %, preferably in an amount of 1 to 4.5 wt % and most especially preferably 2 to 4 wt %, each based on the total washing agent or cleaning agent.

Co-surfactants according to this patent application are amphiphilic molecules with a small hydrophilic head group. In a binary system with water, these co-surfactants are only slightly soluble or not at all soluble. Accordingly, they also do not form any micelles there. In the presence of the claimed anionic and nonionic surfactants, the co-surfactants are incorporated into their associates and thereby change the morphology of these associates. Rod micelles and/or disk micelles are formed from the spherical micelles. When the total surfactant content is high enough, the desired development of lamellar phases and/or structures occurs. Thus, the inorganic salt and the co-surfactant contribute to the development of the lamellar phases and/or structures.

Suitable alkoxylated $C_{12}$-$C_{18}$ fatty alcohols with a degree of alkoxylation of <3 comprise, for example, i-$C_{13}H_{27}O(CH2CH_2O)_2H$, i-$C_{13}H_{27}O(CH2CH_2O)_3H$, $C_{12-14}$ alcohol with 2 EO, $C_{12-14}$ alcohol with 3 EO, $C_{13-15}$ alcohol with 3 EO, $C_{12-18}$ alcohols with 2 EO and $C_{12-18}$ alcohols with 3 EO.

Additional suitable co-surfactants include 1-hexanol, 1-heptanol, 1-octanol, 1,2-octanediol, stearic monoglycerol and mixtures thereof. Also suitable are fragrance alcohols such as geraniol or fragrance aldehydes such as lilial or decanal as co-surfactants.

Preferred co-surfactants include $C_{12}$-$C_{18}$ fatty alcohols with a degree of alkoxylation of <3. These co-surfactants are incorporated especially well into the associates of the anionic and nonionic surfactant.

It may be preferable for the washing agent or cleaning agent to additionally contain a $C_{12}$-$C_{18}$ fatty acid. $C_{12}$-$C_{18}$ fatty acids can have a positive influence on the development of lamellar structures and/or phases and can support their development in particular.

It may be especially preferable for the washing agent or cleaning agent to contain both the neutralized and non-neutralized forms of a $C_{12}$-$C_{18}$ fatty acid. This is advantageous in particular with washing agents or cleaning agents that contain fatty acid soaps because the non-neutralized fatty acid content of these can be adjusted very easily through the pH, for example, by adding pH adjusting agents. Suitable $C_{12}$-$C_{18}$ fatty acids include lauric acid, myristic acid, palmitic acid, stearic acid, (hydrogenated) erucic acid, behenic acid, coconut fatty acid, palm kernel fatty acid, olive oil fatty acid and/or tallow fatty acid.

The non-neutralized fatty acid content in a liquid washing agent or cleaning agent containing fatty acid soap can be determined experimentally by titration, for example, or it can be determined with the help of the Henderson-Hasselbalch equation if the pKa value of the fatty acid used is known.

Alternatively, the fatty acid soap may be derived from a fatty acid other than the $C_{12}$-$C_{18}$ fatty acid, which is used to further support the development of lamellar structures and/or phases.

The total amount of surfactant in the liquid washing agent or cleaning agent is up to 70 wt %, preferably 6 to 70 wt %, more preferably 6 to 45 wt %, based on the total liquid washing agent or cleaning agent.

Another essential component of the washing agent or cleaning agent according to the invention is the inorganic salt, which is used in an amount of 0.5 to 10 wt %, preferably in an amount of 1 to 8 wt %, and most especially preferably 2 to 5 wt %, each based on the total washing agent or cleaning agent, depending on the surfactant system used.

Preferred inorganic salts include sodium chloride, potassium chloride, sodium sulfate, sodium carbonate, potassium sulfate, potassium carbonate, sodium bicarbonate, potassium bicarbonate, calcium chloride, magnesium chloride and mixtures thereof. Particularly stable washing agents or cleaning agents are obtained by using sodium chloride or mixtures of sodium chloride and potassium sulfate.

Addition of the inorganic salt supports the development of lamellar structures. In addition, the inorganic salt has an influence on the viscosity of the washing agent or cleaning agent, and the viscosity can be adjusted with the help of the inorganic salt, so that the washing agent or cleaning agent can be dosed well, and a container with the washing agent or cleaning agent can be emptied well.

Finally, the agent also contains at least one liquid amphiphilic organic compound. "Liquid" as used in this context, means that the compound is in liquid form at 20° C. and 1 bar atmospheric pressure. The amphiphilic compound is selected from mono-, di- or polyhydric alcohols, ethers, esters, dioxolanes and combinations thereof. In various embodiments, the compound comprises at least one hydroxyl group, ester group, dioxolane group and/or ether group.

Examples of compounds include, e.g., monoalcohols such as methanol, ethanol, 1-propanol, isopropanol, 1-butanol, 2-butanol and tert-butanol, monomeric diols such as propanediols, butanediols, pentanediols, hexanediols, heptanediols, octanediols, monomeric and polymeric glycols such as (poly)ethylene glycol and (poly)propylene glycol, polyols such as glycerol, esters such as ethyl acetate, ketones such as acetone, methyl ethyl ketone (MEK), methyl isobutyl ketone (MIBK), ethers such as THF, imines such as polyethyleneimine, and combinations thereof.

In various embodiments, the amphiphilic compound is preferably selected from the group consisting of butyl glycol, propylene glycol, 3-methoxy-3-methyl-1-butanol, 2,2-dimethyl-4-hydroxymethyl 1,2-dioxolane, propylene carbonate, butyl lactate, 2-isobutyl-2-methyl-1,3-dioxolane-4-methanol or mixtures thereof, especially preferably propylene carbonate. The amphiphilic compounds are used in an amount of 0.1 to 5 wt %, based on the total weight of the washing agent formulation.

In various embodiments, the agents described herein also contain at least one hydrotrope. The term "hydrotrope" as used in conjunction with the present invention relates to additives or solvents, which cause an increase in the water solubility of sparingly soluble (hydrophobic) organic compounds. A second component (i.e., the hydrotrope) is added to the sparingly soluble substance but is not a solvent itself. Such hydrotropes have hydrophilic and hydrophobic structural units (like surfactants) but without having the tendency to form aggregates in water (in contrast with surfactants). In various embodiments, these hydrotropes do not have any micelle-forming activity, or the critical micelle-forming concentration (CMC) is greater than $10^{-4}$ mol/liter, preferably greater than $10^{-3}$ mol/liter and even more preferably $10^{-2}$ mol/liter. In accordance with the general understanding in the prior art, the "critical micelle-forming concentration" is the concentration of the corresponding substance, above which it begins to form micelles, and any additional molecule added to the system enters the micelles.

The hydrotropes used are selected from short-chain alkylbenzene sulfonates, for example, in particular $C_{1-6}$ alkylbenzene sulfonates, including but not limited to cumene sulfonate, toluene sulfonate and/or xylene sulfonate. These compounds allow a greater flexibility with regard to the amphiphilic compound to thereby reduce the viscosity and the flow limit. The hydrotropic compounds are preferably used in a range of 0.1 to 5 wt %, more preferably of 1 to 2 wt %, based on the total weight of the washing agent or cleaning agent formulation.

In many lamellar formulations, minor instabilities (a hardly visible phase separation) may occur during storage over a period of time due to the addition of solvents. To improve long-term stability, structure-imparting polymers may be added to the washing agent formulations according to the invention. Such structure-imparting polymers comprise polyacrylates, (microfibrillar) cellulose, clays or gums, such as gellan gum, alginate, carrageenan, xanthan gum and guar. Xanthan gum is especially preferred. The structure-imparting polymers are preferably used in a range of 0.1 to 5 wt %, more preferably of 0.1 to 0.2 wt %, based on the total weight of the washing agent formulation.

In addition to the ionic surfactant, the nonionic surfactant, the inorganic salt, the co-surfactant and the amphiphilic compound as well as optionally the hydrotrope and/or the structure-imparting polymer, the washing agent or cleaning agent may also contain additional ingredients, which further improve the use properties and/or aesthetic properties of the washing agent or cleaning agent. Within the scope of the present invention, the washing agent or cleaning agent preferably also contains one or more substances from the group of builders, bleaching agents, enzymes, nonaqueous solvents, pH adjusting agents, perfumes, perfume carriers, fluorescent agents, dyes, foam inhibitors, silicone oils, antiredeposition agents, soil release agents, shrinkage preventers, anti-wrinkle agents, dye transfer inhibitors, antimicrobial active ingredients, germicides, fungicides, antioxidants, preservatives, corrosion inhibitors, antistatic agents, bitter agents, ironing aids, phobicizing agents and impregnating agents, swelling agents and antislip agents, softening components and UV absorbers.

In particular silicates, aluminum silicates (in particular zeolites), carbonates, salts of organic di- or polycarboxylic acids as well as mixtures of these substances can be mentioned as builders that may be present in the washing agent or cleaning agent.

Crystalline or amorphous alkali aluminosilicates may be used in amounts of 1 wt % to 5 wt % as inorganic, water-insoluble, water-dispersible builder materials. Of these, crystalline aluminosilicates of washing agent quality, in particular zeolite NaA and optionally NaX are preferred. Suitable aluminosilicates in particular do not have any particles with a grain size of more than 30 μm and preferably consist of at least 80 wt % particles less in 10 μm in size. Their calcium binding power, which can be determined in accordance with the instructions in German Patent DE 24 12 837, is in the range of 100 to 200 mg CaO per gram. Suitable substitutes or partial substitutes for the aforementioned aluminosilicate include crystalline alkali silicates, which may be present alone or in mixture with amorphous silicates.

The alkali silicates that can be used as builders in the agents preferably have a molar ratio of alkali oxide to $SiO_2$ of less than 0.95, in particular of 1:1.1 to 1:12, and may be present in amorphous or crystalline form. Preferred alkali silicates include sodium silicates, in particular amorphous sodium silicates with a $Na_2O:SiO_2$ molar ratio of 1:2 to 1:2.8. Such amorphous alkali silicates are available commercially under the brand name Portil®, for example. Such amorphous alkali silicates with a $Na_2O:SiO_2$ molar ratio of 1:1.9 to 1:2.8 are preferably added as a solid and not in the form of a solution in the course of production. Crystalline silicates that may be present alone or in mixture with amorphous silicates that are used are preferably in the form of crystalline layered silicates with the general formula $Na_2Si_xO_{2x+1}.yH_2O$, where x, the so-called module, is a number from 1.9 to 4, and y is a number from 0 to 20, and preferred values for x are 2, 3 or 4. Preferred crystalline layered silicates are those in which x in the aforementioned formula assumes values of 2 or 3. In particular both β and δ-sodium disilicates ($Na_2Si_2O_5.yH_2O$) are preferred. Crystalline alkali silicates of the aforementioned general formula, in which x denotes a number from 1.9 to 2.1, and which are practically anhydrous and are produced from amorphous alkali silicates, can be used in the agents described herein. In another preferred embodiment of agents according to the invention, a crystalline sodium layered silicate with a module of 2 to 3 is used, such as that which can be produced from sand and soda. In another preferred embodiment, crystalline sodium silicates with a module in the range of 1.9 to 3.5 are used. The alkali silicate content in the agents according to the invention may amount to 1 wt % to 15 wt %, based on anhydrous active substance. If alkali aluminosilicate, in particular zeolite, is present as an additional builder substance, then the alkali silicate content preferably amounts to 1 wt % to 10 wt % and in particular 2 wt % to 8 wt %, based on anhydrous active substance. The weight ratio of aluminosilicate to silicate, each based on anhydrous active substances, then preferably amounts to 4:1 to 10:1. The weight ratio of amorphous alkali silicate to crystalline alkali silicate in agents containing both amorphous and crystalline alkali silicates is preferably 1:2 to 2:1 and in particular 1:1 to 2:1.

The water-soluble organic builder substances include in particular those from the class of polycarboxylic acids, in particular citric acid and sugar acids, but also adipic acid, succinic acid, glutaric acid, malic acid, tartaric acid, maleic acid, fumaric acid, aminocarboxylic acids such as nitriloacetic acid, methylglycine diacetic acid (MGDA), glutamine diacetic acid (GLDA), derivatives of the aforementioned and mixtures thereof. Also suitable are polymeric (poly) carboxylic acids, in particular the polycarboxylates, polymeric acrylic acids, methacrylic acids, maleic acids and copolymers thereof, which are accessible in particular by oxidation of polysaccharides and may also contain small amounts of polymerizable substances without a carboxylic acid functionality polymerized into them. The relative molecular weight of the homopolymers of unsaturated carboxylic acids is generally between 5000 g/mol and 200,000 g/mol, that of the copolymers is between 2000 g/mol and 200,000 g/mol, preferably 50,000 g/mol to 120,000 g/mol, based on free acid. A particularly preferred acrylic acid-maleic acid copolymer has a relative molecular weight of 50,000 g/mol to 100,000 g/mol. Suitable, although less preferred, compounds of this class include the copolymers of acrylic acid or methacrylic acid with vinyl ethers, such as vinyl methyl ethers, vinyl esters, ethylene, propylene and styrene, in which the acid content amounts to at least 50 wt %. The water-soluble organic builder substances used may also be terpolymers containing as monomers two carboxylic acids and/or their salts as well as vinyl alcohol and/or a vinyl alcohol derivative or a carbohydrate as the third monomer. The first acidic monomer or its salt is derived from a monoethylenically unsaturated $C_3$-$C_8$ carboxylic acid and preferably from a $C_3$-$C_4$ monocarboxylic acid, in particular from (meth)acrylic acid. The second acidic monomer or its salt may be a derivative of a $C_4$-$C_8$ dicarboxylic acid, wherein maleic acid is especially preferred. In this case, the third monomeric unit is formed by vinyl alcohol and/or preferably an esterified vinyl alcohol. Preferred vinyl alcohol derivatives are in particular those which are an ester of short-chain carboxylic acids, for example, $C_1$-$C_4$ carboxylic acids with vinyl alcohol. Preferred terpolymers contain 60 wt % to 95 wt %, in particular 70 wt % to 90 wt % (meth)acrylic acid and/or (meth)acrylate, especially preferably acrylic acid and/or acrylate and maleic acid and/or maleate as well as 5 wt % to 40 wt %, preferably 10 wt % to 30 wt % vinyl alcohol and/or vinyl acetate. Terpolymers in which the weight ratio of (meth)acrylic and/or (meth) acrylate to maleic acid and/or maleate is between 1:1 and 4:1, preferably between 2:1 and 3:1 and in particular 2:1 and 2.5:1 are most especially preferred. Both the amounts and weight ratios are based on the acids. The second acid monomer or its salt may also be a derivative of an alkyl sulfonic acid that is substituted in position 2 with an alkyl radical, preferably with a $C_1$-$C_4$ alkyl radical or an aromatic radical derived preferably from benzene or benzene derivatives. Preferred terpolymers contain 40 wt % to 60 wt %, in particular 45 to 55 wt % (meth)acrylic acid and/or (meth) acrylate, especially preferably acrylic acid and/or acrylate, 10 wt % to 30 wt %, preferably 15 wt % to 25 wt % methallyl sulfonic acid and/or methallyl sulfonate and, as the third monomer, 15 wt % to 40 wt %, preferably 20 wt % to 40 wt % of a carbohydrate. This carbohydrate may be a mono-, di-, oligo- or polysaccharide, for example, where mono-, di- or oligosaccharides are preferred, especially preferably sucrose. These terpolymers generally have a relative molecular weight between 1000 g/mol and 200,000 g/mol, preferably between 2000 g/mol and 50,000 g/mol and in particular between 3000 g/mol and 10,000 g/mol. They may be used in particular to prepare liquid agents in the form of aqueous solutions, preferably in the form of 30 to 50 wt % aqueous solutions. All the aforementioned polycarboxylic acids are usually used in the form of their water-soluble salts, in particular their alkali salts.

Such organic builder substances are preferably present in amounts up to 40 wt %, in particular up to 25 wt % and especially preferably from 1 wt % to 5 wt %.

In a preferred embodiment, the washing agent or cleaning agent according to the invention also contains at least one enzyme. Enzymes that are optionally present are preferably selected from the group comprising protease, amylase, lipase, cellulase, hemicellulase, oxidase, peroxidase, pectinase and mixtures thereof. Protease obtained primarily from microorganisms such as bacteria or fungi and yeasts may be considered. Protease can be obtained in a known way by fermentation processes from suitable microorganisms. Proteases are commercially available, for example, under the names BLAP®, Savinase®, Esperase®, Maxatase®, Optimase®, Alcalase®, Durazym® or Maxapem®. The lipase that can be used can be obtained, for example, from *Humicola lanuginosa*, from *Bacillus* species, from *Pseudomonas* species, from *Fusarium* species, from *Rhizopus* species or from *Aspergillus* species. Suitable lipase is available commercially, for example, under the name Lipolase®, Lipozym®, Lipomax®, Lipex®, Amono® lipase, Toyo-Jozo® lipase, Meito® lipase and Diosynth® lipase. Suitable amylases are available commercially under the name Maxamyl®, Termamyl®, Duramyl® and Purafect® OxAm, for example. The cellulase that can be used may be an enzyme, which preferably has an optimum pH in the weakly acidic to weakly alkaline range of 6 to 9.5 and is obtained from bacteria or fungi. Such cellulases are available commercially under the names Celluzyme®, Carezyme® and Ecostone®. Suitable pectinases are available, for example, under the names Gamanase®, Pektinex AR®, X-Pect® or Pectaway® from Novozymes, under the names Rohapect UF®, Rohapect TPL®, Rohapect PTE100®, Rohapect MPE®, Rohapect MA plus HC, Rohapect DA12L®, Rohapect 10L®, Rohapect B1L® from AB Enzymes and under the names Pyrolase® from Diversa Corp., San Diego, Calif., USA.

In preferred embodiments, the agent according to the invention contains as the enzyme at least one enzyme selected from protease, amylase, cellulase, mannanase, lipase and pectate lyase.

The enzyme(s) amount(s) to 0.01 to 10 wt %, preferably 0.12% to about 3 wt %, based on the total washing agent or cleaning agent. The enzymes are preferably used in the form of liquid enzyme formulation(s).

DETAILED DESCRIPTION OF THE INVENTION

The washing agents or cleaning agents are liquid and contain water as the main solvent. It is preferable for the washing agent or cleaning agent to contain more than 5 wt % water, preferably more than 15 wt % and in particular preferably more than 25 wt %, each based on the total amount of washing agent or cleaning agent.

In addition, nonaqueous solvents that are different from the aforementioned amphiphilic compounds and hydrotropes can be added to the washing agent or cleaning agent.

In addition to these ingredients, a washing agent or cleaning agent may also contain dispersed particles preferably having a diameter of 1 to 1000 μm along their largest spatial extent.

Particles in the sense of the present invention may be capsules, abrasive substances as well as powders, granules or compounds of insoluble compounds in the washing agent or cleaning agent, but capsules are preferred.

The term "capsule" is understood to refer, on one hand, to aggregates with a core-shell structure and, on the other hand, to aggregates with a matrix. Core-shell capsules contain at least one solid or liquid core enclosed in at least one continuous shell, in particular a shell of polymer(s).

Sensitive chemically or physically incompatible and volatile components (=active ingredients) of the liquid washing agent or cleaning agent may be enclosed in the interior of the capsules, so that they are stable in storage and shipping, for example, optical brighteners, surfactants, chelating agents, bleaches, bleach activators, dyes and fragrances, antioxidants, builders, enzymes, enzyme stabilizers, antimicrobial active ingredients, soil release agents, antiredeposition agents, pH adjusting agents, electrolytes, detergency enhancers, vitamins, proteins, foam inhibitors and UV absorbers may be contained in the capsules. The capsules fillings may be solids or liquids in the form of solutions or emulsions and/or suspensions.

The capsules may be in any form within the context determined by production, but they are preferably approximately spherical. Their diameter along their largest spatial extent may be between 1 μm and 1000 μm, depending on the application and the components present in the interior.

Alternatively, particles that do not have a core-shell structure but instead have the active ingredient distributed in a matrix of a matrix-forming material may also be used. Such particles are also referred to as "speckles."

In these materials, the matrix is formed by gelation, polyanion-polycation interactions or polyelectrolyte-metal ion interactions, for example, and is just as well known in the prior art as is the production of particles using these matrix-forming materials. Alginate is one example of a matrix-forming material. To produce alginate-based speckles, an aqueous alginate solution, which also contains the active ingredient(s) to be enclosed is converted to droplets and then hardened in a precipitation bath containing $Ca^{2+}$ ions or $Al^{3+}$ ions. Alternatively, other matrix-forming materials may also be used instead of alginate.

The particles can form a stable dispersion in liquid washing agents or cleaning agents. "Stable" here means that the washing agents or cleaning agents are stable at room temperature for a period of at least 4 weeks, preferably at least 6 weeks, without the particles rising to the top, accumulating or setting out in the agent.

The active ingredients are usually released from the capsules by destruction of the shell and/or matrix due to mechanical, thermal, chemical or enzymatic action.

In a preferred embodiment, the liquid washing agents or cleaning agents contain capsules, which themselves contain one or more fragrances.

Alternatively, the particles may comprise abrasive substances such as beads of plastic or calcium carbonate as well as powders, granules or compounds of compounds insoluble in the washing agent or cleaning agent.

In a preferred embodiment of the invention, the liquid washing agent or cleaning agent contains the same or different particles in amounts of 0.05 to 10 wt %, in particular 0.1 to 8 wt % and extremely preferably 0.2 to 5 wt %.

The washing agent or cleaning agent can be used for washing and/or cleaning textile fabrics or hard surfaces. Washing or cleaning methods, i.e., in particular methods for cleaning textiles are characterized in general in that active cleaning substances are applied to the item to be cleaned in one or more method steps and are washed away after the treatment time, or the item to be cleaned is otherwise treated with a washing agent or cleaning agent or a solution of that agent.

In the aforementioned washing or cleaning method, in particular washing method, temperatures of up to 95° C. or less, 90° C. or less, 60° C. or less, 50° C. or less, 40° C. or less, 30° C. or less or 20° C. or less are used in various embodiments of the invention. These temperature specifications are based on the temperatures used in the washing or cleaning steps.

The washing agent or cleaning agent is produced by conventional and known methods and processes. For example, the ingredients of the washing agents or cleaning agents are combined in stirred vessels, with water being added first. Then the nonaqueous solvents and surfactants including the co-surfactant as well as the amphiphilic compounds and optionally the hydrotrope and/or the polymeric structuring agent are added. Next, the fatty acid, if any, is added and the fatty acid component is saponified and the anionic surfactants used in acid form are neutralized. Then the additional ingredients are added, preferably in portions. The inorganic salt may be added as a solid or in the form of a concentrated solution at various times during the production process.

The flow limits of the washing agents or cleaning agents can be measured at 23° C. by using a rotational rheometer from TA Instruments, model AR G2. This is a so-called controlled shear stress rheometer.

To measure the flow limit using a controlled shear stress rheometer, various methods with which those skilled in the art are familiar are described in the literature.

To determine the flow limits in the context of the present invention, the following procedure is used at 23° C.

The samples are subjected to a shear stress s(t) which increases over time in the rheometer. For example, the shear stress may be increased from the lowest possible value (e.g., 2 mPa) to 10 Pa, for example, over a period of 10 minutes. The deformation $\gamma$ of the sample is measured as a function of this shear stress. The deformation is plotted as a function of shear stress in a double logarithmic plot. If the sample tested has a flow limit, one will be able to differentiate two regions distinctly in this plot. Below a certain shear stress, one finds a purely elastic deformation. The slope of the curve $\gamma(\sigma)$ (log log plot) is one in this range. The flow range begins above this shear stress and the slope of the curve is suddenly higher. The shear stress at which the curve has a discontinuity, i.e., the transition from elastic deformation to plastic deformation marks the flow limit. A convenient method of determining the discontinuity in the curve is by applying tangents to the two curve parts. Samples without a flow limit do not have the characteristic discontinuity in the function $\gamma(\sigma)$.

In various embodiments, the flow limit is between 0.01 and 1000 Pa, preferably in the range of 0.01 to 100 Pa or 0.2 to 100 Pa, even more preferably 1 to 50 Pa or 0.01 to 10 Pa.

The agents may be packaged in film bags, for example. Packaging bags of water-soluble films make it unnecessary for the package to be opened by the consumer. This permits a convenient dosing of a single portion measured for one wash cycle by placing the bag directly in the washing machine or by adding the bag to a certain amount of water, for example, in a bucket, a pan or a hand-washing basin. The film bag surrounding the washing portion then dissolves without leaving a residue on reaching a certain temperature.

There are numerous state-of-the-art methods for producing water-soluble washing agent portions that are fundamentally also usable within the scope of the present invention. The best-known methods are the tube film methods using horizontal and vertical sealing seams. In addition, the thermoforming method (deep drawing method) is also suitable for producing film bags or washing agent portions in a stable form. However, the water-soluble sheathings need not necessarily be made of a film material but instead may also be containers of a stable form that can be obtained, for example, by an injection molding method.

In addition, methods for producing water-soluble capsules from polyvinyl alcohol or gelatin are also known, making it possible in principle to provide capsules having a high degree of filling. These methods are based on the fact that the water-soluble polymer is introduced into a molding cavity. The capsules are filled and sealed either in synchronization or in successive steps. In the latter case, the capsules are filled through a small opening. Filling of the capsules here preferably takes place through a filling wedge, which is situated above two drums which have hemispherical shells on their surface and rotate in opposition to one another. The drums carry polymer strips that cover the hemispherical shell cavities. Sealing takes place in the positions in which the polymer strip on one drum comes in contact with the polymer strip on the opposite drum. In parallel with that the filling material is injected into the resulting capsule, with the injection pressure of the filling liquid pressing the polymer strips into the hemispherical shell cavities. A method for producing water-soluble capsules in which the filling takes place first and the sealing is performed next is based on the so-called Bottle Pack® method, in which a tubular parison is guided into a two-part cavity. The cavity is closed whereupon the lower portion of tube is sealed. Then the tube is inflated to form the capsule shape in the cavity, filled and next sealed.

The shell material used to produce the water-soluble portion is preferably a water-soluble thermoplastic polymer, especially preferably selected from the group of (optionally partially acetalized) polyvinyl alcohol, polyvinyl alcohol copolymer, polyvinyl pyrrolidone, polyethylene oxide, gelatin, cellulose and derivatives thereof, starch and derivatives thereof, blends and composites, inorganic salts and mixtures of the aforementioned materials, preferably hydroxypropylmethyl cellulose and/or polyvinyl alcohol blends. The polyvinyl alcohols are commercially available, for example, under the trademark Mowiol® (Clariant). Polyvinyl alcohols that are especially suitable within the scope of the present invention include, for example, Mowiol® 3-83. Mowiol® 4-88, Mowiol® 5-88, Mowiol® 8-88 as well as Clariant L648. The water-soluble thermoplastic used to produce the portion may additionally comprise polymers selected from the group consisting of acrylic acid-containing polymers, polyacrylamides, oxazoline polymers, polystyrene sulfonates, polyurethanes, polyesters, polyethers and/or mixtures of the aforementioned polymers. It is preferable if the water-soluble thermoplastic to be used comprises a polyvinyl alcohol having a degree of hydrolysis of 70 to 100 mol %, preferably 80 to 90 mol %, especially preferably 81 to 89 mol % and in particular 82 to 88 mol %. It is further preferable for the water-soluble thermoplastic used to comprise a polyvinyl alcohol with a molecular weight in the range of 10,000 to 100,000 $gmol^{-1}$, preferably 11,000 to 90,000 $gmol^{-1}$, especially preferably 12,000 to 80,000 $gmol^{-1}$ and in particular 13,000 to 70,000 $gmol^{-1}$. It is also preferable if the thermoplastics are present in amounts of at least 50 wt %, preferably of at least 70 wt %, especially preferably of at least 80 wt % and in particular of at least 90 wt %, each based on the weight of the water-soluble thermoplastic polymer.

All the facts, objects and embodiments described for the agents according to the invention can also be applied to the subject matter of the invention, the methods and/or use. Reference is therefore made explicitly at this point to the disclosure in the corresponding location, with the notation that this disclosure is also applicable to the methods and uses described herein.

EXAMPLES

The following formulations were prepared according to the method described above:

TABLE 1

Liquid washing agent with a flow limit

| | F1 (wt %) | F2 (wt %) | F4 (wt %) | F5 (wt %) | F6 (wt %) |
|---|---|---|---|---|---|
| $C_{11-13}$ alkylbenzene sulfonic acid | 23.0 | 26.0 | 9.0 | 3.0 | 6.0 |
| ($C_{12-14}$) fatty alcohol ether sulfate with two units of ethylene oxide | — | — | 9.0 | 4.6 | 6.0 |
| $C_{13-15}$ alkyl alcohol branched in position 2 and ethoxylated with 8 mol ethylene oxide | 24.0 | 27.0 | 6.0 | — | 3.0 |
| Fatty alcohol ether ethoxylated with 7 mol ethylene oxide | — | — | — | 3.7 | — |
| $C_{12}$-$C_{18}$ fatty alcohol alkoxylated with 2 mol ethylene oxide | 4.0 | 2.0 | 2.5 | — | 1.0 |
| i-$C_{13}H_{27}O(CH_2CH_2O)_3H$ | — | 2.0 | — | 1.5 | 1.0 |
| Propylene carbonate | 5.0 | 1.0 | 1.0 | 0.5 | 1.5 |
| 1,2-Propyleneglycol | — | 3.5 | 2.0 | 1.0 | — |
| 3-Methoxy-3-methyl-1-butanol | — | — | 2.0 | — | — |
| 2,2-Dimethyl-4-hydroxymethyl-1,2-dioxolane | — | — | — | 1.0 | — |
| Ethanol | — | — | 0.5 | 0.2 | 0.4 |
| 2-Aminoethanol | 6.8 | 6.8 | — | — | — |
| Cumene sulfonate | — | 1.5 | — | 1.0 | 1.5 |
| Sodium hydroxide | — | — | 4.0 | 0.6 | 2.0 |
| Ethoxylated polyethyleneimine | 5.0 | 5.0 | — | — | — |
| $C_{12-18}$ fatty acid | 7.5 | 7.5 | 1.0 | 1.3 | 3.0 |
| Diethylenetriamine-N,N,N',N',N''-penta-(methylenephosphonic acid), heptasodium salt (sodium DTPMP) | 0.6 | 0.6 | 3.0 | 0.2 | 1.0 |
| Citric acid | — | — | to pH 8.5 | to pH 8.5 | 2.0 |
| Boric acid | — | — | 1.0 | 0.5 | 1.0 |
| Sodium bisulfite | 0.1 | 0.1 | — | — | — |
| Sodium chloride | 2.5 | 1.5 | 4.0 | 2.0 | 4.5 |
| Sodium sulfate | — | 1.5 | — | 2.5 | — |
| Denatonium benzoate | 0.001 | 0.001 | 0.001 | 0.001 | 0.001 |
| Soil-release polymer of ethylene terephthalate and polyethylene oxide terephthalate | 1.0 | 1.0 | 0.5 | — | 0.5 |
| Sokalan HP 56 | — | — | 0.2 | — | — |
| Perfume, dye, protease, amylase, lipase, cellulase, optical brightener | 1.7 | 1.7 | 2.6 | 1.0 | 2.6 |
| Water | to 100 | to 100 | to 100 | to 100 | to 100 |

What is claimed is:

1. A structured liquid washing agent or cleaning agent with a flow limit between 0.01 and 1000 Pa, comprising, based on the total weight of the agent:

(A) 6 to 70 wt %, of a surfactant mixture containing, based on the total weight of the agent:

(i) 5 to 50 wt % anionic surfactant, selected from the group consisting of sulfate surfactants, sulfonate surfactants and mixtures thereof;

(ii) 0.5 to 35 wt % nonionic surfactant, selected from the group consisting of alkoxylated fatty alcohols with a degree of alkoxylation of >4, alkoxylated fatty acid esters, fatty acid amides, alkoxylated fatty acid amides, polyhydroxy fatty acid amides, alkyl phenol polyglycol ethers, amine oxides, alkyl polyglucosides and mixtures thereof and (iii) 0.5 to 5 wt % of a co-surfactant selected from the group consisting of alkoxylated C8-C18 fatty alcohols with a degree of alkoxylation of <3, aliphatic C6-C14 alcohols, aromatic C6-C14 alcohols, aliphatic C6-C12 dialcohols, monoglycerides of C12-C18 fatty acids, monoglycerol ethers of C8-C18 fatty alcohols and mixtures thereof;

(B) 0.5 to 10 wt % inorganic salt, and (C) 0.1 to 5 wt % of a liquid amphiphilic organic compound selected from mono-, di- or polyhydric alcohols, ethers, esters, dioxolanes and combinations thereof;

(D) 0.1 to 5 wt % of at least one hydrotrope compound selected from the group consisting of C1 to C6 alkylbenzene sulfonates.

2. The structured liquid washing agent or cleaning agent according to claim 1, wherein the inorganic salt is selected from the group consisting of sodium chloride, potassium chloride, sodium sulfate, sodium carbonate, potassium sulfate, potassium carbonate, sodium bicarbonate, potassium bicarbonate, calcium chloride, magnesium chloride and mixtures thereof.

3. The structured liquid washing agent or cleaning agent according to claim 1 also containing 0.1 to 5 wt % of an external structure-imparting polymer.

4. The structured liquid washing agent or cleaning agent according to claim 1, wherein the liquid washing agent or cleaning agent contains dispersed particles.

5. The structured liquid washing agent or cleaning agent according to claim 1, wherein the anionic surfactant is selected from the group consisting of C9-13 alkylbenzene sulfonates, olefin sulfonates, C12-18 alkane sulfonates, ester sulfonates, alk(en)yl sulfates, fatty alcohol ether sulfates and mixtures thereof.

6. The structured liquid washing agent or cleaning agent according to claim 1, wherein the weight ratio of nonionic surfactant to ionic surfactant is in the range of 1:1 to 1:3.

7. The liquid washing agent or cleaning agent according to claim 1, wherein the agent also contains at least one additional ingredient selected from the group consisting of enzymes, enzyme stabilizers, builders, bleaches, nonaqueous solvents, pH adjusting agents, odor absorbers, deodorizing substances, perfumes, perfume carriers, fluorescent agents, dyes, foam inhibitors, silicone oils, antiredeposition agents, soil release agents, shrinkage preventers, anti-wrinkle agents, dye transfer inhibitors, antimicrobial active ingredients, germicides, fungicides, antioxidants, preservatives, corrosion inhibitors, antistatics, bitter agents, ironing aids, phobicizing and impregnation aids, swelling and anti-slip agents, softening components and UV absorbers.

8. A washing method comprising the method steps:

a) providing a washing or cleaning solution, comprising a washing agent or cleaning agent according to claim 1, and b) bringing a textile fabric or a hard surface in contact with the washing or cleaning solution according to (a).

9. The structured liquid washing agent or cleaning agent according to claim 3 also containing 0.1 to 0.2 wt % of an external structure-imparting polymer selected from the group consisting of polyacrylates, cellulose, clays, gums and mixtures thereof.

10. The structured liquid washing agent or cleaning agent according to claim 1, comprising, based on the total weight of the agent, 1 to 2 wt % of a secondary hydrotrope, selected from the group consisting of cumene sulfonate, toluene sulfonate, xylene sulfonate and mixtures thereof.

11. The structured liquid washing agent or cleaning agent according to claim 4, wherein the liquid washing agent or cleaning agent contains dispersed microparticles.

12. The structured liquid washing agent or cleaning agent according to claim 11, wherein the liquid washing agent or cleaning agent contains dispersed microparticles, selected from microcapsules, abrasive substances and/or insoluble ingredients of the washing agent or cleaning agent.

13. The structured liquid washing agent or cleaning agent according to claim 5, wherein the anionic surfactant is selected from the group consisting C9-13 alkylbenzene sulfonates, fatty alcohol ether sulfates and mixtures thereof.

14. The structured liquid washing agent or cleaning agent according to claim 6, wherein the weight ratio of nonionic surfactant to ionic surfactant is in the range of 1:2 to 1:2.5.

* * * * *